US012274922B1

(12) United States Patent
Lai

(10) Patent No.: US 12,274,922 B1
(45) Date of Patent: Apr. 15, 2025

(54) MAGNETIC PICKLEBALL

(71) Applicant: Jinlong Lai, Jinjiang (CN)

(72) Inventor: Jinlong Lai, Jinjiang (CN)

( * ) Notice: Subject to any disclaimer, the term of this patent is extended or adjusted under 35 U.S.C. 154(b) by 0 days.

(21) Appl. No.: 18/384,391

(22) Filed: Oct. 27, 2023

(51) Int. Cl.
*A63B 43/06* (2006.01)
*A63B 71/06* (2006.01)
*A63B 59/42* (2015.01)

(52) U.S. Cl.
CPC ..... *A63B 43/06* (2013.01); *A63B 71/0622* (2013.01); *A63B 59/42* (2015.10); *A63B 2071/0625* (2013.01); *A63B 2209/08* (2013.01); *A63B 2225/74* (2020.08)

(58) Field of Classification Search
CPC ..... A63B 43/06; A63B 2071/0625; A63B 2209/08; A63B 43/002; A63B 47/02
See application file for complete search history.

(56) References Cited

U.S. PATENT DOCUMENTS 4,577,865 A * 3/1986 Shishido ..... A63B 43/00 473/570
4,595,200 A * 6/1986 Shishido ..... A63B 43/00 473/570
4,834,393 A * 5/1989 Feldi ..... A63B 47/02 473/573
5,158,284 A * 10/1992 Vogl ..... A63B 43/00 273/DIG. 20
5,236,383 A * 8/1993 Connelly ..... A63B 43/06 473/576
5,775,800 A * 7/1998 Hsieh ..... F21V 33/008 362/800
8,663,040 B2 * 3/2014 Kortegast ..... A63B 43/06 473/570
11,491,374 B1 * 11/2022 Newcomb ..... A63B 43/06
11,975,244 B1 * 5/2024 Liu ..... A63B 43/06
2003/0216196 A1 * 11/2003 Lamson ..... A63B 49/035 473/549
2007/0281811 A1 * 12/2007 Wang ..... A63B 43/06 473/570
2014/0274465 A1 * 9/2014 Francis ..... A63B 39/00 473/613
2016/0001137 A1 * 1/2016 Phillips ..... A63B 37/00 473/570
2016/0354646 A1 * 12/2016 Wang ..... A63B 43/06
2018/0043218 A1 * 2/2018 Hu ..... A63B 41/00
2023/0201672 A1 * 6/2023 You ..... A63B 37/0098 473/570
2023/0338802 A1 * 10/2023 Sharpe ..... A63B 43/00
2024/0335705 A1 * 10/2024 Liang ..... A63B 43/06

* cited by examiner

*Primary Examiner* — Steven B Wong
(74) *Attorney, Agent, or Firm* — Jose Cherson Weissbrot

(57) ABSTRACT

A magnetic pickleball comprising a hollow body and a plurality of second magnetic parts attached to the body, wherein, the body is provided with a roughly spherical outer hub, and a plurality of holes are also formed on the body, and the plurality of holes are evenly distributed around an outer surface of the body; and wherein the second magnetic part comprises a closed end and an open end, and a diameter of the closed end is larger than that of the hole; and wherein when the plurality of second magnetic parts are attached to the body, the open end is embedded in the holes, so that the body forms a substantially regular ball.

15 Claims, 14 Drawing Sheets

MAGNETIC PICKLEBALL

TECHNICAL FIELD

The present invention relates to the technical field of sports equipment, in particular to a magnetic pickleball.

BACKGROUND

Pick ball originated from Benbridge Island in Seattle, USA. It is a mixed sport that combines tennis, badminton and table tennis. pick ball is similar in size to tennis. It is a thin-shell hollow ball made of hard plastic with 26 holes with a diameter of about 1 cm. The pick racket is shaped like a larger table tennis bat. In terms of physical activity and mobility, pick balls are more active than badminton and table tennis, so it is better than badminton and table tennis in physical exercise. However, the amount of activity and exercise of pick ball is smaller than that of tennis, therefore people who do not play tennis very much are suitable to play pick ball as a regular exercise, and the venue of pick ball is exactly the same as that of badminton.

In the United States, pick ball has become a regular sport in middle school physical education class, and it has gradually become common among young people and the elderly, and now it has become a common sport in middle school physical education class. However, the traditional paddle of the pick ball is too short, so it is not easy to rebound, and it is difficult for the elderly and the injured to get the ball back in the game without bending over.

For example, U.S. patent Ser. No. 17/817,788 discloses a telescopic device for paddles, which is a telescopic paddle. The telescopic paddle is located at the top of the racket, and the ball can be picked up by passing the telescopic paddle through the round hole of the pick ball. However, this device may damage the ball in the process of picking up the ball, and the efficiency of picking up the ball is low, therefore it is impossible to pick up a large number of pick balls in a short time.

Although all the above patents provide technical solutions for picking up the pick balls, there are many problems in the practical use of the technical solutions disclosed above, which greatly reduce the user's experience. In addition, the traditional game of the pick ball is relatively simple, and the rules of tennis, badminton and table tennis are basically used for reference, which will reduce the freshness of users after repeated use, and users always want to gain new experiences in the old sports.

Based on the above problems, it is necessary to provide a brand-new pick racket and pick balls. The pick racket can pick up a large number of pick balls in a short time without causing damage to the balls. At the same time, the pick racket and pick ball also have other functions to play more games, such as lighting, etc., to further improve the user's experience by constantly refreshing the user's freshness.

SUMMARY

The present invention provides a magnetic pickleball comprising a hollow body and a plurality of second magnetic parts attached to the body.

wherein, the body is provided with a roughly spherical outer hub, and a plurality of holes are also formed on the body, and the plurality of holes are evenly distributed around an outer surface of the body; and wherein the second magnetic part comprises a closed end and an open end, and a diameter of the closed end is larger than that of the hole; and wherein when the plurality of second magnetic parts are attached to the body, the open end is embedded in the holes, so that the body forms a substantially regular ball.

The present invention also provides a magnetic pickleball, comprising a hollow body and a second magnetic part arranged inside the body; and wherein, the body is provided with a roughly spherical outer hub, and a plurality of holes are also formed on the body, and the holes are evenly distributed around an outer surface of the body; and wherein a bracket is arranged inside the body, and the bracket extends from one end of the body to the other end, wherein the bracket is provided with a receiving seat at a central position passing through the body, and the receiving seat receives the second magnetic part.

The present invention also provides a magnetic pickleball, comprising a hollow body, and a plurality of second magnetic parts and a plurality of optical components detachably attached to the body; and wherein, the body is provided with a roughly spherical outer hub, and a plurality of holes are also formed on the body, and the holes are evenly distributed around an outer surface of the body; and wherein, the second magnetic parts comprise a closed end and an open end, the diameter of the closed end is larger than that of the hole, and when the plurality of second magnetic parts are detachably attached to the body, the open end is embedded in the hole, so that the body forms a substantially regular ball; and wherein, the optical component comprises a connecting part and a light-emitting part, the optical component is detachably connected to the body through the connecting part, and the light-emitting part emits light in response to a user's instruction.

The terms "invention." "the invention," "this invention" and "the present invention" used in this patent are intended to refer broadly to all of the subject matter of this patent and the patent claims below. Statements containing these terms should be understood not to limit the subject matter described herein or to limit the meaning or scope of the patent claims below. Embodiments of the invention covered by this patent are defined by the claims below, not this summary. This summary is a high-level overview of various embodiments of the invention and introduces some of the concepts that are further described in the Detailed Description section below. This summary is not intended to identify key or essential features of the claimed subject matter, nor is it intended to be used in isolation to determine the scope of the claimed subject matter. The subject matter should be understood by reference to appropriate portions of the entire specification of this patent, any or all drawings and each claim.

BRIEF DESCRIPTION OF DRAWINGS

In order to explain the technical scheme of this application more clearly, the drawings needed in the implementation will be briefly introduced below. Obviously, the drawings described below are only some implementations of this application. For those skilled in the art, other drawings can be obtained according to these drawings without creative work.

In the figures.

Figure 1:
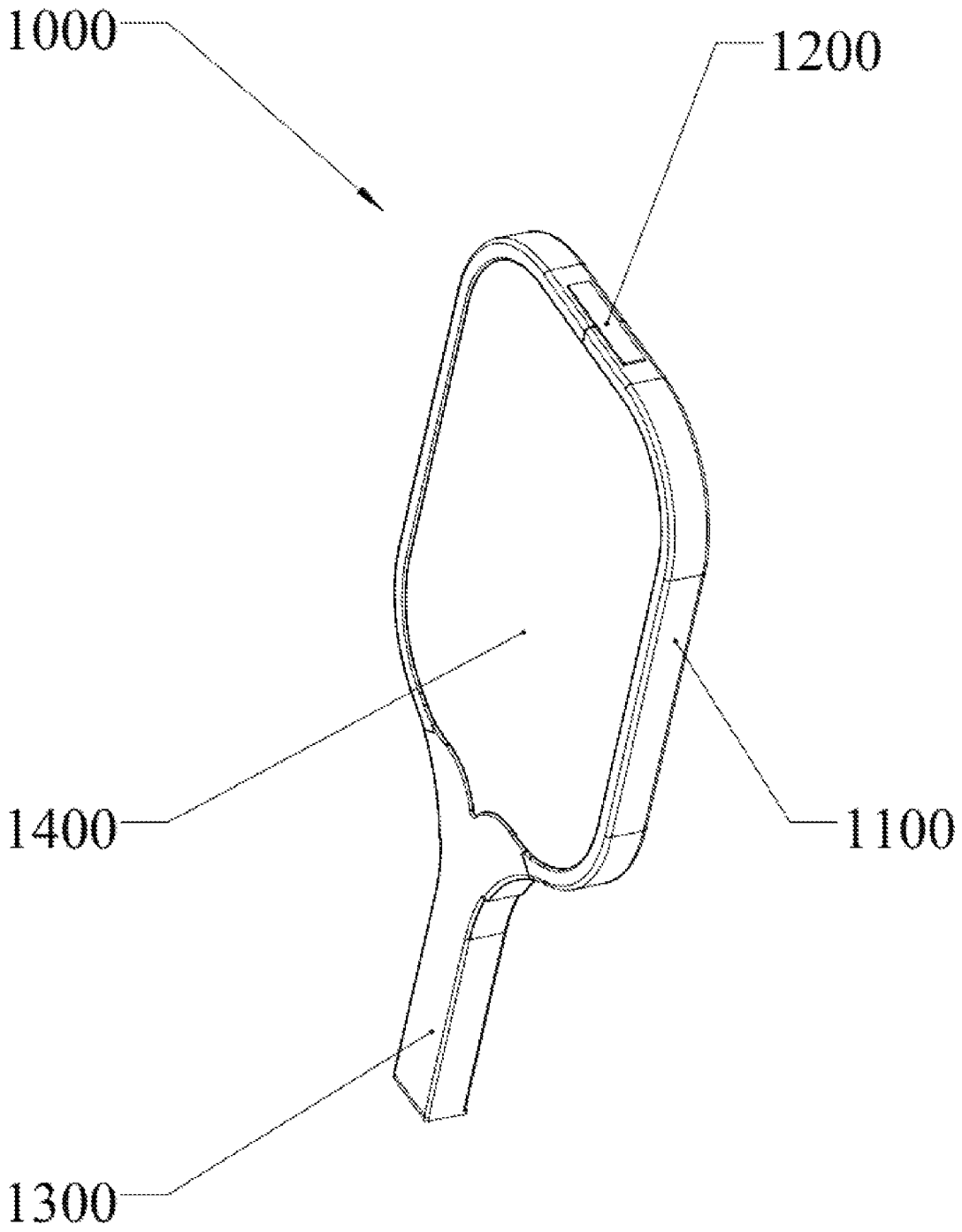
FIG. 1 is a schematic diagram of a multifunctional racket applied by the present invention.

1000, Multifunctional pick racket; 1100, Frame component; 1110, Upper edge; 1120, Lower edge; 1130, Sidewall; 1140, Space; 1150, Left frame; 1151, Locking-tight part; 1160, Right frame; 1161, Locking part; 1200, First magnetic part; 1300, Handle; 1400, Panel component; 1401, Clamping groove; 1410, First panel; 1420, Second panel; 1430, Support plate; 1440, Display body; 1500, Light-emitting component; 1510, Light-emitting element; 1520, Control circuit board; 1521, Switch; 1522, Input port; 1523, Output port; 1530, Power supply; 2000, Pick Ball; 2000, Magnetic pickup ball; 2100, Main body; 2110, Hole; 2130, Upper shell; 2140, Lower shell; 2150, Bracket; 2160, Receiving seat; 2200, Second magnetic part; 2210, Closed end; 2220, Open end; 2230, Convex column; 2231, Outer wall surface; 2232, Inner wall surface; 2233, Receiving groove; 2234, Tightening ring; 2235, Fastening hoop; 2240, Magnetic buckle; 2250, Snap-on housings; 2260, the incline; 2261, the edge; 2300, Optical component; 2400, Image mask; 2410, Line-work; 2420, Shadow layer; 2430, Color layer.

DESCRIPTION OF EMBODIMENTS

In describing the preferred embodiments, specific terminology will be resorted to for the sake of clarity. It is to be understood that each specific term includes all technical equivalents which operate in a similar manner to accomplish a similar purpose.

While various aspects and features of certain embodiments have been summarized above, the following detailed description illustrates a few exemplary embodiments in further detail to enable one skilled in the art to practice such embodiments. Reference will now be made in detail to embodiments of the inventive concept, examples of which are illustrated in the accompanying drawings. The accompanying drawings are not necessarily drawn to scale. The described examples are provided for illustrative purposes and are not intended to limit the scope of the invention. It should be understood, however, that persons having ordinary skill in the art may practice the inventive concept without these specific details.

It will be understood that, although the terms first, second, etc. may be used herein to describe various elements, these elements should not be limited by these terms. These terms are only used to distinguish one element from another. For example, a first attachment could be termed a second attachment, and, similarly, a second attachment could be termed a first attachment, without departing from the scope of the inventive concept.

It will be understood that when an element or layer is referred to as being "on," "coupled to," or "connected to" another element or layer, it can be directly on, directly coupled to or directly connected to the other element or layer, or intervening elements or layers may be present. In contrast, when an element is referred to as being "directly on," "directly coupled to," or "directly connected to" another element or layer, there are no intervening elements or layers present. Like numbers refer to like elements throughout. As used herein, the term "and/or" includes any and all combinations of one or more of the associated listed items.

As used in the description of the inventive concept and the appended claims, the singular forms "a," "an," and "the" are intended to include the plural forms as well, unless the context clearly indicates other.

As a preferred embodiment of the present invention application, in order to make the sport of the pick ball play in a variety of ways and have playability, and make users have a constant sense of freshness during the exercise, the present invention application provides a multifunctional pick racket 1000.

Referring to FIG. 1, in this embodiment, a multifunctional pick racket 1000 includes a frame component 1100, a handle 1300 fixedly connected with a first magnetic part 1200 and a panel component 1400.

Figure 2:
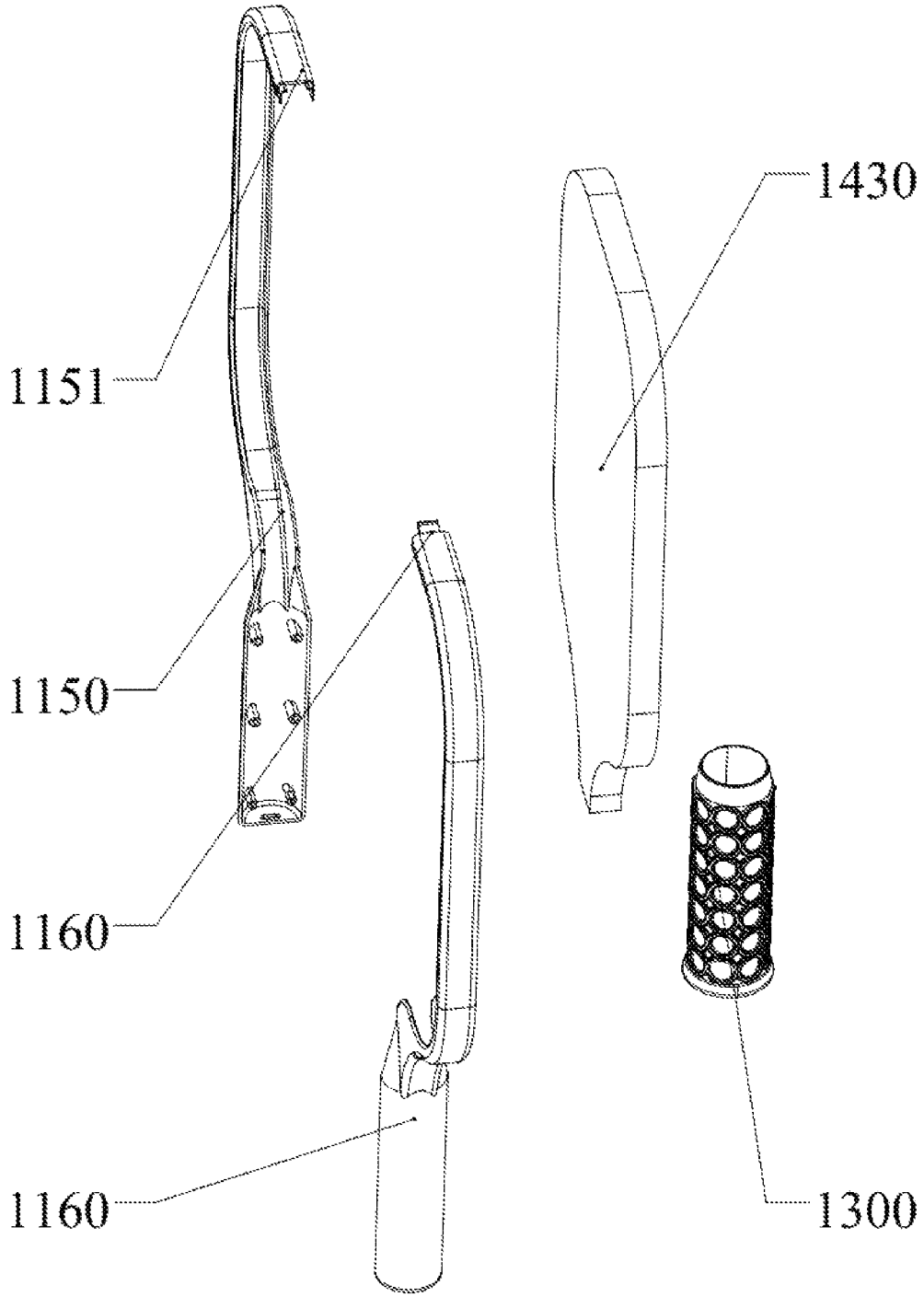
FIG. 2 is a schematic diagram of a part of the present application.
Figure 3:
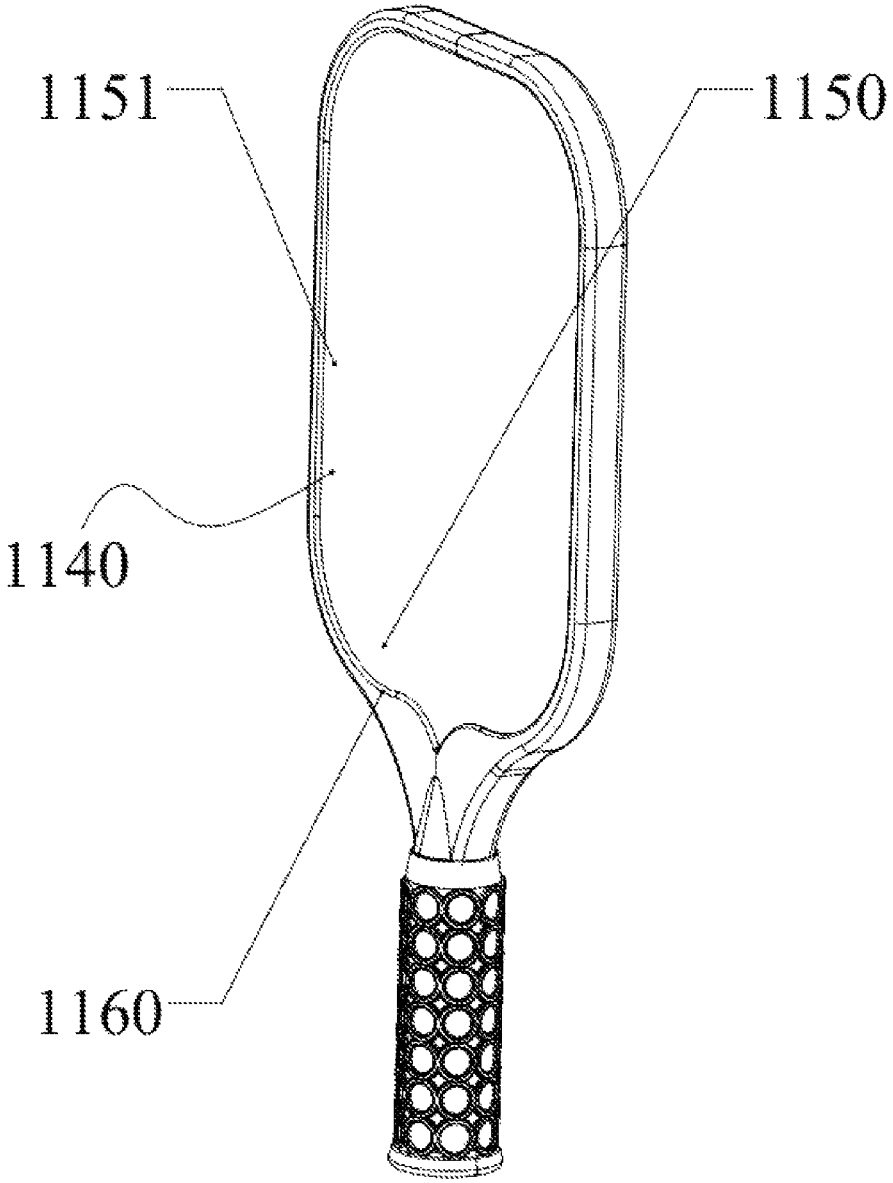
FIG. 3 is a schematic diagram of a part of the present application.

Referring to FIGS. 2 and 3, the frame component 1100 includes an upper edge 1110, a lower edge 1120 and a sidewall 1130 connecting the upper edge 1110 and the lower edge 1120. The upper edge 1110, the lower edge 1120 and the sidewall 1130 form a closed space 1140 for placing the panel component 1400, and the upper edge 1110 and the lower edge 1120 fix the panel component 1400 in the space 1140.

Further, the frame component 1100 has a symmetrical structure, including a left frame 1150 and a right frame 1160, which have the same shape and size. The left frame 1150 is provided with at least one locking-tight part 1151, and the right frame 1160 is provided with at least one locking part 1161. In this embodiment, the locking-tight part 1151 and the locking part 1161 are in snap connection, and the left frame 1150 and the right frame 1160 are detachably connected together through snap fit.

In other embodiments (not shown), the quantitative characteristics of the locking-tight part 1151 and the locking part 1161 may be one or multiple. At the same time, the left frame 1150 and the right frame 1160 can be connected in other ways, such as threaded connection, magnetic connection or pin connection, as long as the left frame 1150 and the right frame 1160 can be connected and fixed normally.

Referring to FIG. 1 and FIG. 3, in this embodiment, the handle 1300 is sleeved with hand glue, which is constructed as a sweat-absorbing and anti-slip structure, and a rubber ring for fixing the hand glue is sleeved above the hand glue. The handle 1300 and the frame component 1100 are fixedly connected by integral molding, and the Shore hardness of the handle 1300 is not less than that of the frame component 1100. Shore hardness refers to the reading of the value measured by Shore hardness tester, which is widely used for hardness measurement of rubber and plastic. In other embodiments (not shown in the figure), the handle 1300 and the frame component 1100 can be separately molded and then detachably connected and fixed by connectors.

Figure 4:
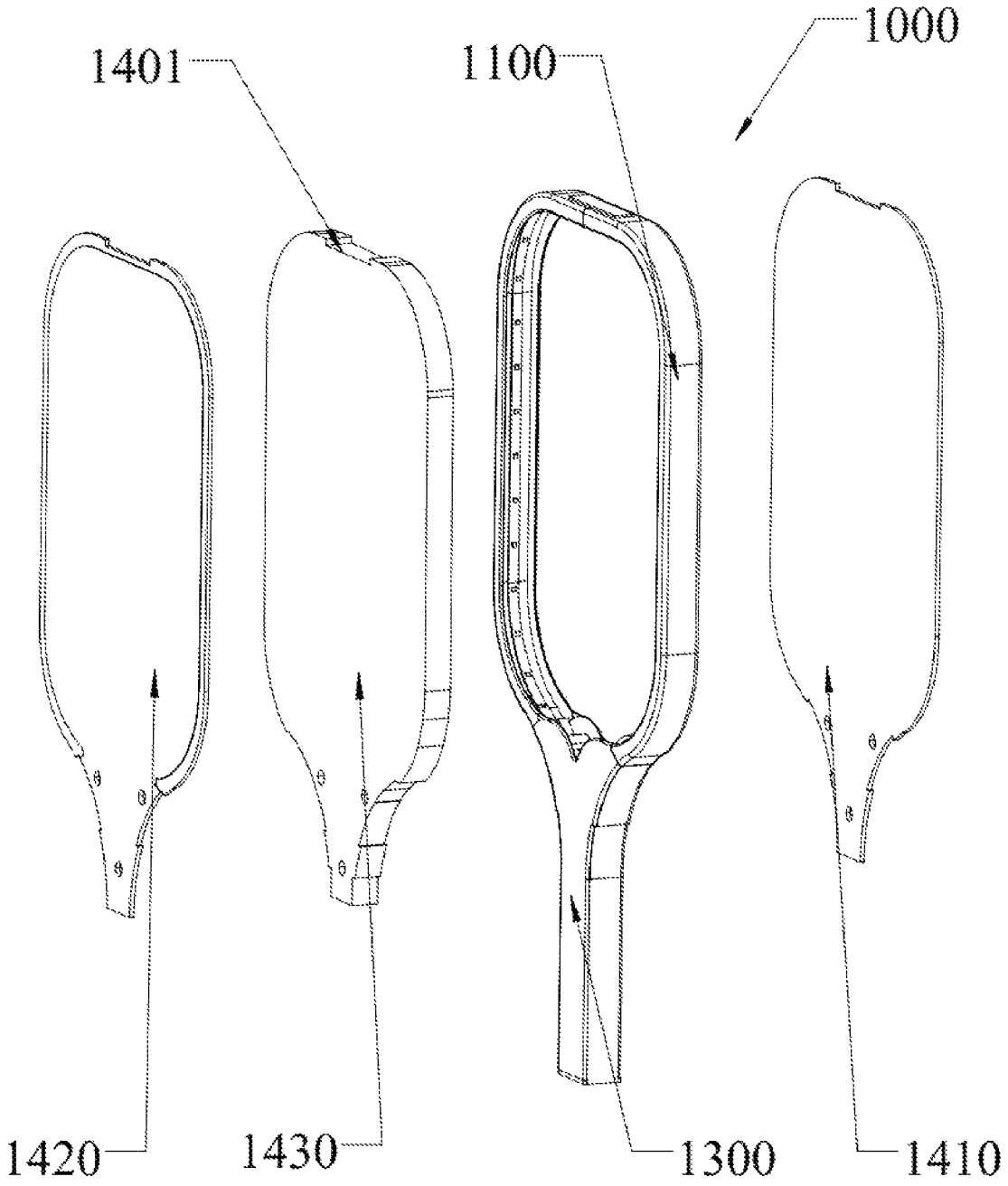
FIG. 4 is an exploded view of the multifunctional racket applied by the present invention.
Figure 5:
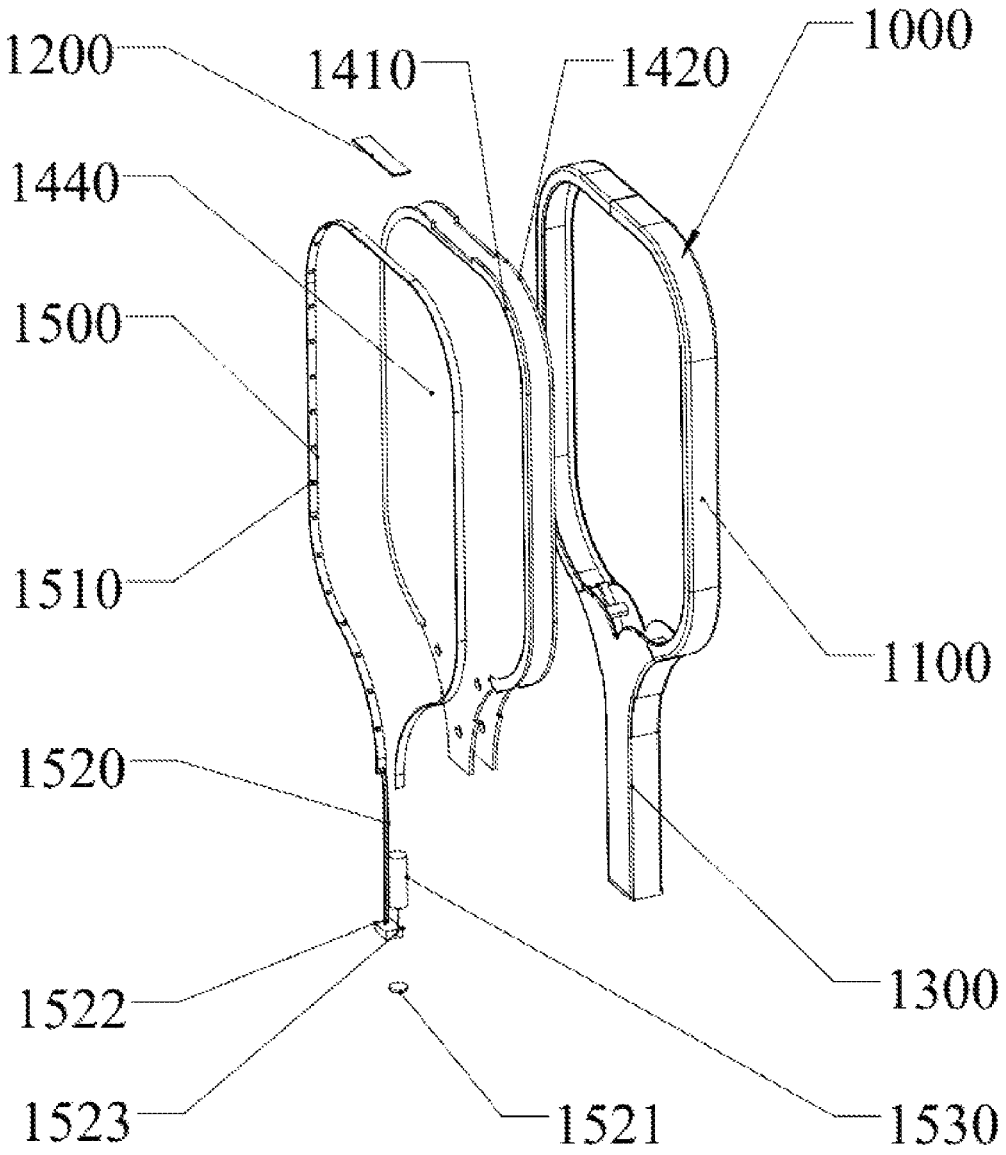
FIG. 5 is an exploded view of the multifunctional racket applied by the present invention.

Referring to FIGS. 4 and 5, in this embodiment, the panel component 1400 is made of light-transmitting materials, including a first panel 1410, a second panel 1420 and a support plate 1430. The first panel 1410 and the second panel 1420 are two panels of the same size and shape. The first panel 1410 and the second panel 1420 are arranged in parallel on both sides of the support plate 1430, which is sandwiched between the first panel 1410 and the second panel 1420.

Referring to FIGS. 4 and 5, the panel component 1400 is provided with a clamping groove 1401, which is arranged at the end opposite to the handle 1300 and is used for accommodating the first magnetic part 1200. When the frame component 1100 is integrated, the first magnetic part 1200 is embedded between the panel component 1400 and the frame component 1100.

Further, the first panel 1410 and the second panel 1420 are made of a glass fiber material, and the support plate 1430 has a dense honeycomb structure. Honeycomb structure is a common design of pick racket, in which the interior of the racket face presents a honeycomb grid structure, which is helpful to improve the lightweight and strength of the racket. In some alternative embodiments (not shown in the figure), the structure of the support plate 1430 can be a multi-layer structure, or a mixed material structure, or a single material structure and other alternative honeycomb structures.

The material can also be carbon fiber, which is a light but high-strength material, and is often used to make high-end pick rackets, which can provide excellent strength and control; or wood, which is a traditional material of pick racket, provides good feeling and control; or aluminum, aluminum is a light but high-hardness material, which is often used to make pick rackets, and can provide excellent strength and durability; or foam, which is a light but elastic material, is often used in the core of a pick racket, which can provide excellent strength and control; or polymer, which is a light but high-strength material, is often used in the core of pick racket, which can provide excellent strength and durability; or glass fiber or composite material, which can provide the strongest attack force and feedback the force of contact ball like a spring; or graphite, graphite is a more economical carbon fiber, and its feel and attack power are similar to those of carbon fiber.

Preferably, the first panel 1410 and the second panel 1420 are provided with multi-layer image masks 2400, which can be used for printing images or characters, and can display corresponding color pictures under the illumination of lights, thus improving the ornamental performance of the multifunctional pick racket 1000 and having decorative effects. Among them, the first panel 1410 and the second panel 1420 have a surface and a back surface, the surface is the side for hitting the ball, and the back surface is the side contacting with the support plate 1430. The color map shown by the image mask 2400 is set on the back. When illuminated by the light source, the color picture comes from the pattern on the back and is displayed by the pattern on the back. The surfaces of the first panel 1410 and the second panel 1420 also have corresponding patterns, and the patterns on the surfaces are used for decoration when there is no light source.

Figure 6:
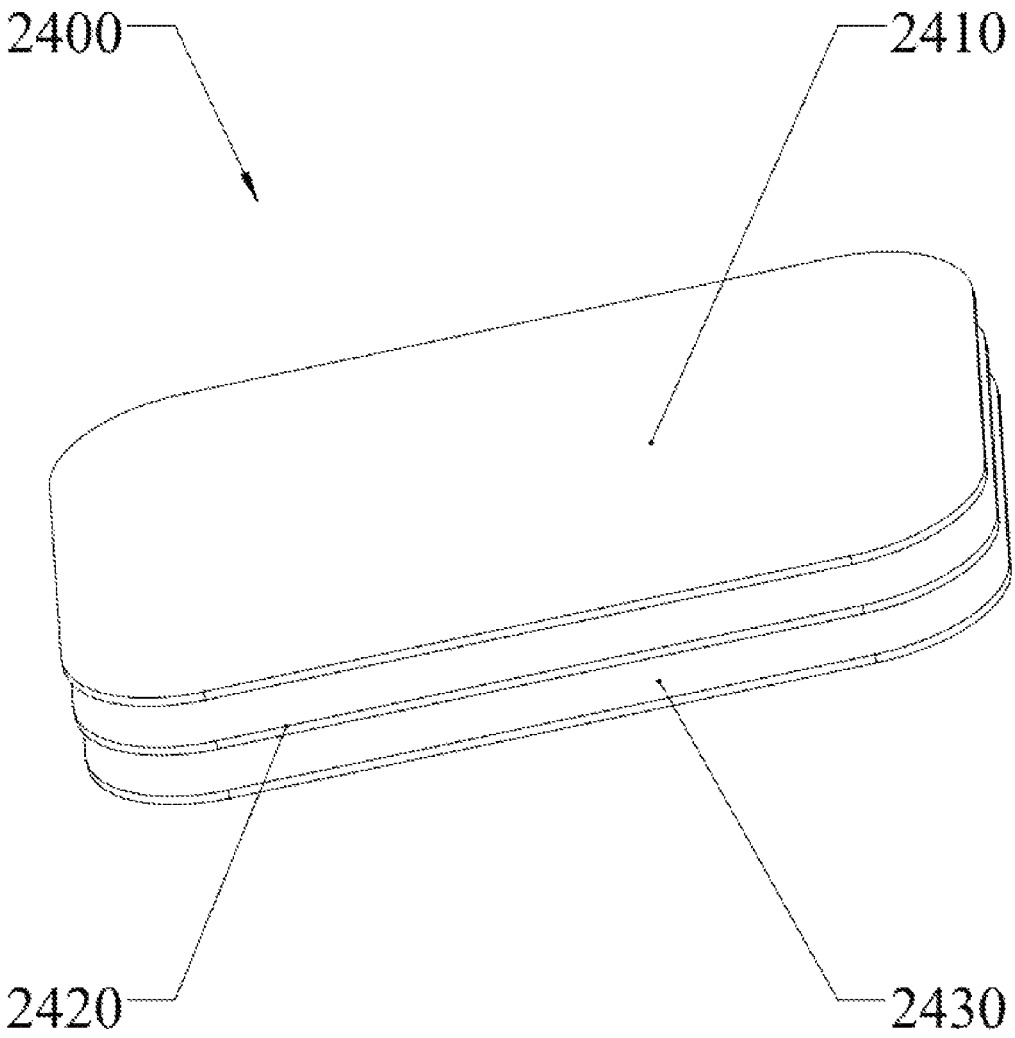
FIG. 6 is a schematic diagram of an image mask of the present application.

Referring to FIG. 6, the image mask 2400 is composed of three layers, namely a line-work 2410, a shadow layer 2420 and a color layer 2430. Among them, the line-work 2410 is at the top, the shadow layer 2420 is in the middle, and the color layer 2430 is at the bottom. When the light shines on the image mask 2400, the light source is at the back, the color layer 2430 shines first, and it shines on the shadow layer 2420 through the color layer 2430, and the shadow layer 2420 will filter out the opaque parts and display them on the front line-work 2410. The plain line-work 2410 before turning on the light is in contrast with the color pattern after turning on the light, which will bring visual impact.

In other embodiments (not shown in the figure), the image mask 2400 can be composed of layers with other features, and at the same time, the positional relationship of different pattern layers can also be changed, as long as the pick racket 1000 can emit light normally to form a light painting.

Referring to FIG. 5, in this embodiment, the light-emitting component 1500 is detachably connected to the sidewall 1130 of the frame component 1100, and the light-emitting component 1500 surrounds the outer periphery of the panel component 1400. The light-emitting component 1500 includes at least one light-emitting element 1510, and multicolor light can be emitted through the light-emitting element 1510. Since the panel component 1400 is made of light-transmissive materials, when the light-emitting element 1510 emits multicolor light, the panel component 1400 can refract the light to form a lighting effect, and the light passes through the first panel 1410 and the second panel 1420 to make the multi-layer image mask 2400 on the panel shine, thus making the multifunctional pick racket 1000 have a beautiful decorative effect.

Further, the light-emitting component 1500 is connected with a control circuit board 1520 and a power supply 1530. The light-emitting component 1500, the control circuit board 1520 and the power supply 1530 are connected through circuits, the control circuit board 1520 controls the work of the light-emitting component 1500, and the power supply 1530 provides the working voltage for the light-emitting component 1500, and both the control circuit board 1520 and the power supply 1530 are fixedly arranged in the handle 1300.

In this embodiment, the power supply 1530 is a lithium battery. In some alternative embodiments (not shown), the power supply 1530 includes, but is not limited to, a storage battery, a sodium battery, a magnesium battery, a seawater battery, a glass battery, a fuel battery, a zinc-bromine battery and other batteries or a power supply source.

In other embodiments (not shown), the circuits on the control circuit board 1520 may include well-known circuits for performing these functions, including but not limited to an antenna system, an RF transceiver, one or more amplifiers, a tuner, one or more oscillators, a digital signal processor, a CODEC chipset, a subscriber identity module (SIM) card, a memory, and the like.

Further, in this embodiment, the control circuit board 1520 is provided with a switch 1521 and a processor. The switch 1521 is used to control the operation of the light-emitting component 1500, and the switch 1521 is a key switch.

In other embodiments (not shown), the switch 1521 may include physical buttons, such as rocker, dial, slide switch, touch switch, toggle switch and joystick, click wheel, etc. In some alternative embodiments (not shown in the figure), the switch 1521 may be coupled to any of the following (or decoupled): a keyboard, an infrared port, a USB port and a pointing device, such as a mouse. In some embodiments (not shown), the switch 1521 can also be an electronic device, such as a touch screen, a computer device and other control system devices.

Further, the processor communicates with the light emitting module 1500 and controls the operation of the light emitting module 1500 based on the DMX512 control protocol. In other embodiments (not shown), the quantitative characteristic of the processor may be one or multiple.

In other embodiments (not shown in the figure), the communication means can use any of a variety of communication standards, protocols and technologies, including, but are not limited to, global system for mobile communications (GSM), enhanced data GSM environment (EDGE), high-speed downlink packet access (HSDPA), wideband code division multiple access (W-CDMA), code division multiple access (CDMA), time division multiple access (TDMA), BLUETOOTH®, wireless fidelity (Wi-Fi) (for example, IEEE802.11a, IEEE802.11b, IEEE802.11g or IEEE802.11n), Voice over Internet Protocol (VoIP), Wi-MAX, email protocol (e.g., Internet Message Access Protocol (IMAP) and/or post office protocol (POP)), instant messaging (e.g., Extensible Messaging and Presence Protocol (XMPP), SIP for Instant Messaging and Presence Leveraging Extensions (SIMPLE) or Instant Messaging and Presence Service (IMPS), or Short Message Service (SMS), or any other suitable communication protocol, including those developed and not yet completed since the date of submission of this document.

Referring to FIG. 5, in this embodiment, the control circuit board 1520 is also connected with an input port 1522 and an output port 1523. The input port 1522 and the output port 1523 are connected to the control circuit board 1520 through a circuit. In other embodiments (not shown), the quantitative characteristics of the input ports 1522 and the output ports 1523 may be one or multiple.

Further, the power supply 1530 can be charged through the input port 1522, and the power supply 1530 can also be discharged through the output port 1523 to be used as a mobile power supply for charging mobile devices.

Referring to FIG. 1, the present application also provides another multifunctional pick racket 1000. In another embodiment, the multifunctional pick racket 1000 includes a panel component 1400, a handle 1300 fixedly connected with the panel component 1400, and a display body 1440 arranged on the panel component 1400.

Referring to FIGS. 1 to 5, in this embodiment, the multifunctional pick racket 1000 further includes a first magnetic part 1200, which is located at the top of the panel component 1400, away from one end of the handle 1300. The first magnetic part 1200 and the panel component 1400 are detachably connected, and the connection mode is not limited in this embodiment. In other embodiments (not shown in the figure), the connection mode can be adhesive connection mode or other detachable connection modes such as snap connection mode.

In this embodiment, the joint between the panel component 1400 and the handle 1300 is provided with an arc chamfer, and the width of the side where the handle 1300 is connected with the panel component 1400 is larger than that of the other side of the handle 1300, and the handle 1300 is wide at the top and narrow at the bottom.

Referring to FIG. 5, the multi-functional pick racket 1000 further includes a light-emitting component 1500, which surrounds the outer periphery of the panel component 1400. The light component 2300 emits light towards the panel component 1400 and illuminates the panel component 1400 by the light.

Further, in this embodiment, the light-emitting component 1500 is a LED strip, and the light strip is arranged around the outer periphery of the panel component 1400 and fixedly connected to the outer periphery of the panel component 1400.

Further, the light-emitting component 1500 is connected with a control circuit board 1520 and a power supply 1530. The light-emitting component 1500, the control circuit board 1520 and the power supply 1530 are connected through circuits, the control circuit board 1520 controls the work of the light-emitting component 1500, and the power supply 1530 provides the working voltage for the light-emitting component 1500, and both the control circuit board 1520 and the power supply 1530 are fixedly arranged in the handle 1300.

Referring to FIG. 4, in this embodiment, the panel component 1400 is made of a light-transmitting material and includes a first panel 1410, a second panel 1420 and a support plate 1430. The first panel 1410 and the second panel 1420 are two panels with the same size and shape. The first panel 1410 and the second panel 1420 are arranged in parallel on both sides of the support plate 1430, which is sandwiched between the first panel 1410 and the second panel 1420. The first panel 1410 and the second panel 1420 are made of a glass fiber material, and the support plate 1430 has a dense honeycomb structure.

Further, the first panel 1410 and the second panel 1420 are provided with a display body 1440, and the display body 1440 further includes a multi-layer image mask 2400. Specifically, when the light-emitting component 1500 is activated, the light-emitting component 1500 will generate light. Because the panel component 1400 is made of a light-transmitting material, the panel component 1400 will guide the refracted light to pass through the display body 1440, so that the multi-layer image mask 2400 on the panel will shine, thus making the multifunctional pick racket 1000 have a beautiful decorative effect. The side edge of the panel component 1400 is provided with a wrapping, and the wrapping is wrapped around the periphery of the panel component 1400.

Figure 7:
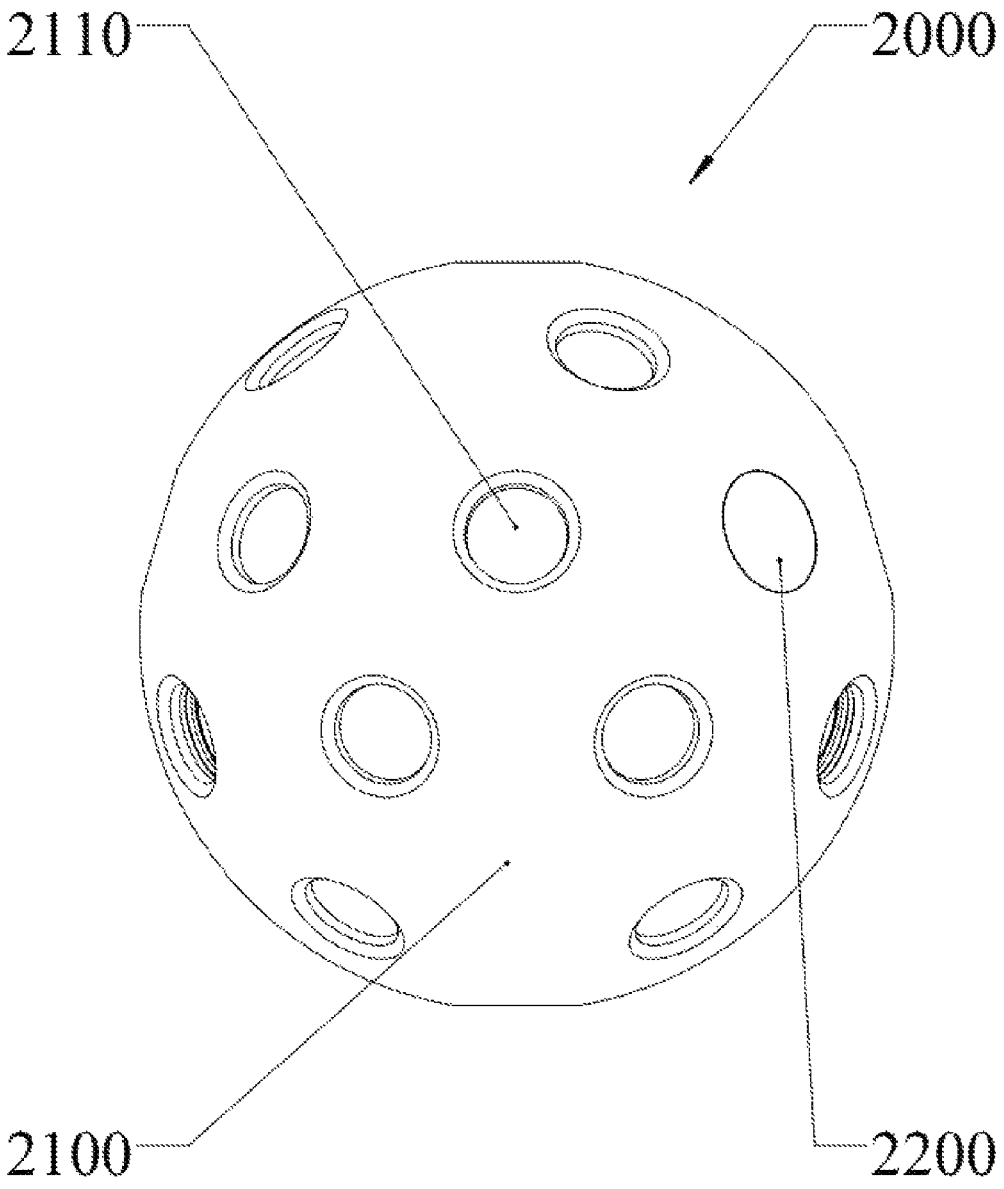
FIG. 7 is a schematic diagram of a pick ball applied by the present invention.

Referring to FIG. 7, as a preferred embodiment of the present application, the present application also provides a magnetic pickup ball 2000, which includes a hollow body 2100 and a plurality of second magnetic parts 2200 attached to the body 2100.

Figure 8:
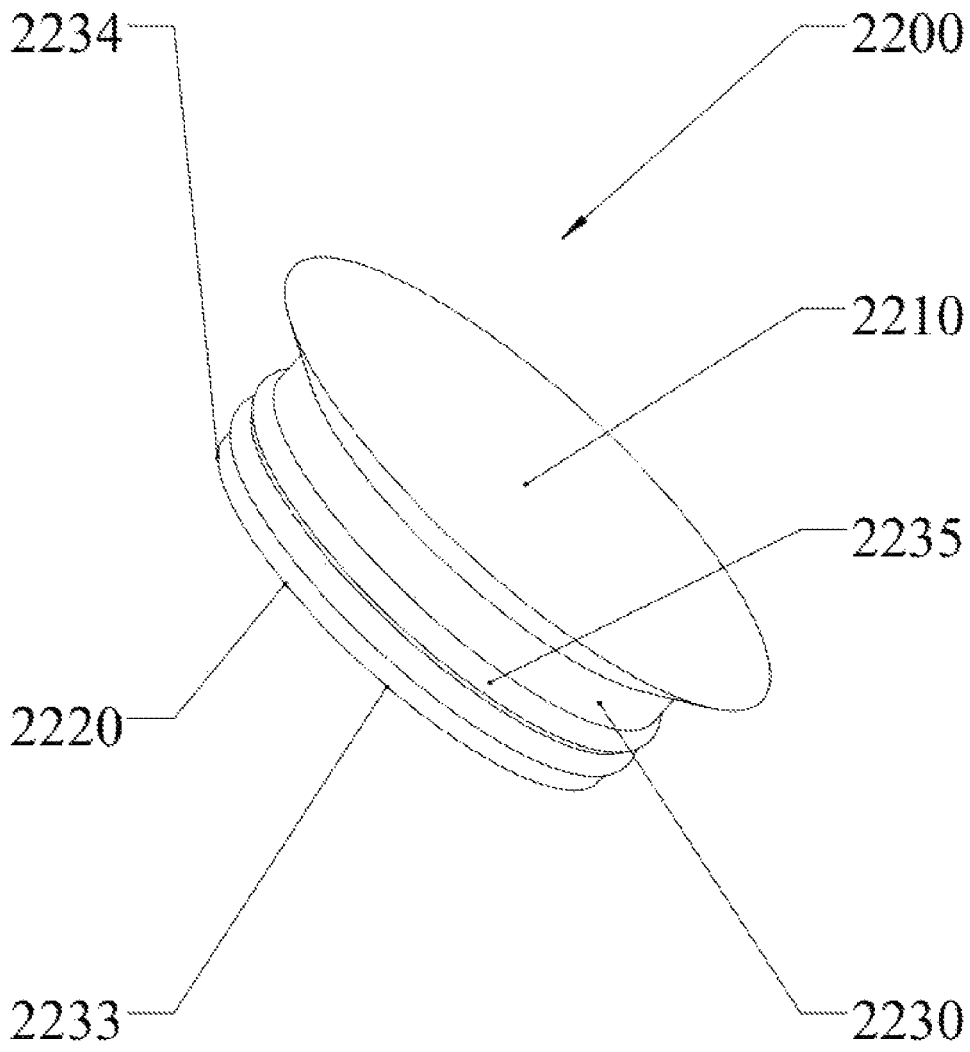
FIG. 8 is a schematic diagram of the magnetic part of the present application.
Figure 9:
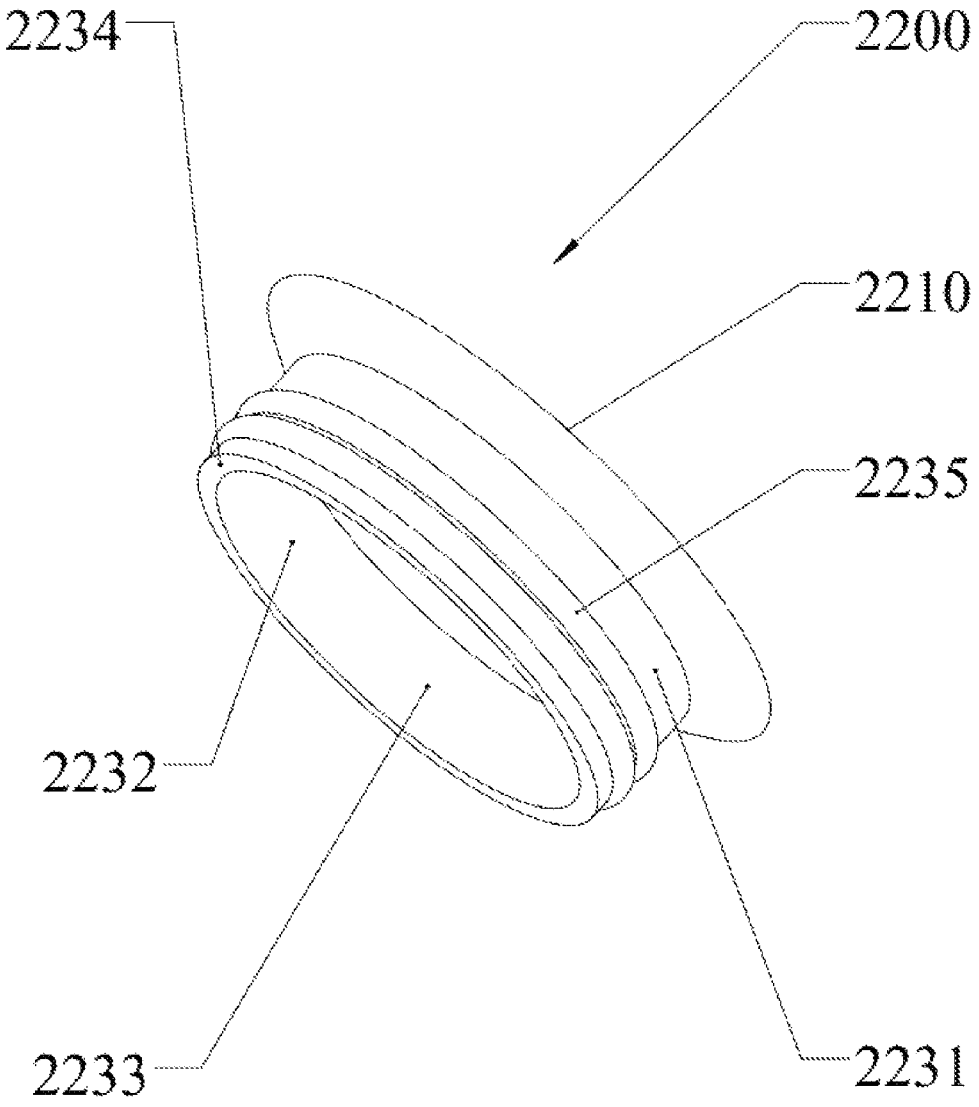
FIG. 9 is a schematic diagram of the magnetic part of the present application.

In this embodiment, referring to FIGS. 8 and 9, the body 2100 has an approximately spherical outer contour, and a plurality of holes 2110 are formed on the body 2100, and the holes 2110 are uniformly distributed on the approximately spherical outer surface of the body 2100.

The second magnetic part 2200 includes a closed end 2210 and an open end 2220, and the diameter of the closed end 2210 is larger than that of the hole 2110. The open end 2220 forms a convex column 2230 toward the closed end 2210. The convex column 2230 has an outer wall surface 2231 and an inner wall surface 2232, and the inner wall surface 2232 is set as a receiving groove 2233, and a magnetic buckle 2240 is also arranged in the receiving groove 2233. The magnetic buckle 2240 has a cylindrical structure, and the side surface of the magnetic buckle 2240 is closely attached to the inner wall surface 2232, so that the magnetic buckle 2240 is firmly arranged in the receiving groove 2233.

Further, the second magnetic part 2200 is also provided with a tightening ring 2234 and a fastening hoop 2235. The tightening ring 2234 surrounds the edge of the open end 2220, and the inner diameter of the tightening ring 2234 is smaller than the diameter of the magnetic buckle 2240. When the magnetic buckle 2240 is placed in the receiving groove 2233, the tightening ring 2234 will play a role of limiting the displacement of the magnetic buckle 2240, so that the magnetic buckle 2240 is firmly located in the receiving groove 2233.

The fastening hoop 2235 is disposed on the outer wall surface 2231 of the second magnetic part 2200 and surrounds the outer wall surface 2231. The outer diameter of the fastening hoop 2235 is larger than the diameter of the hole 2110. The material of the fastening hoop 2235 is made of an elastic material, and the second magnetic part 2200 is fixed in the hole 2110. The fastening hoop 2235 will form a limiting structure, so that the second magnetic part 2200 is firmly embedded in the hole 2110.

In this embodiment, the molding method of the second magnetic part 2200 and the body 2100 is not limited, and the second magnetic part 2200 is made of a rubber material. In other embodiments (not shown in the figure), the second magnetic part 2200 and the body 2100 can be molded integrally or separately. Meanwhile, the material of the second magnetic part 2200 includes, but is not limited to, silicon steel sheet, or soft magnetic ferrite, or Al—Ni—Co permanent magnet alloy, or Fe—Cr—Co permanent magnet alloy, or permanent magnet ferrite, or rare earth permanent magnet materials, such as samarium cobalt and NdFeB.

Specifically, the diameter of the open end 2220 is not larger than the diameter of the hole 2110, and the closed end 2210 also has a substantially spherical outer surface, and the outer surface of the closed end 2210 is tangent to the outer surface of the body 2100. The second magnetic part 2200 is fixed in the hole 2110 of the body 2100 by embedding, so that the body 2100 becomes a roughly regular spherical shape.

In another embodiment (not shown in the figures), the present application also provides another magnetic pickup ball 2000. In this embodiment, the magnetic pickup ball 2000 includes a hollow body 2100 and a plurality of second magnetic parts 2200 attached to the body 2100. The body 2100 has an approximately spherical outer contour, and the body 2100 is provided with a plurality of holes 2110, and the holes 2110 are uniformly distributed on the approximately spherical outer surface of the body 2100.

Figure 10:
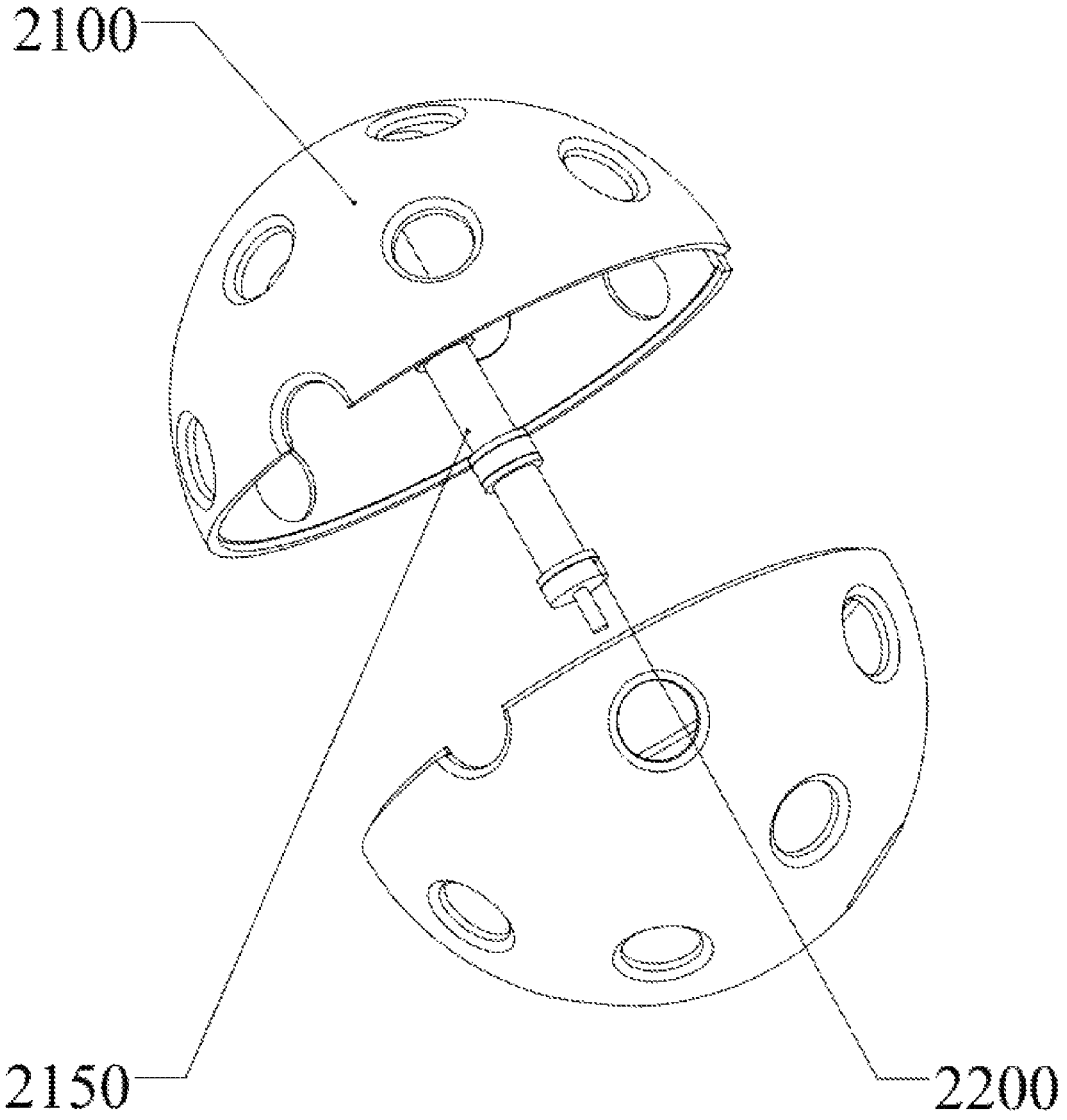
FIG. 10 is a schematic diagram of another embodiment of the present application.
Figure 11:
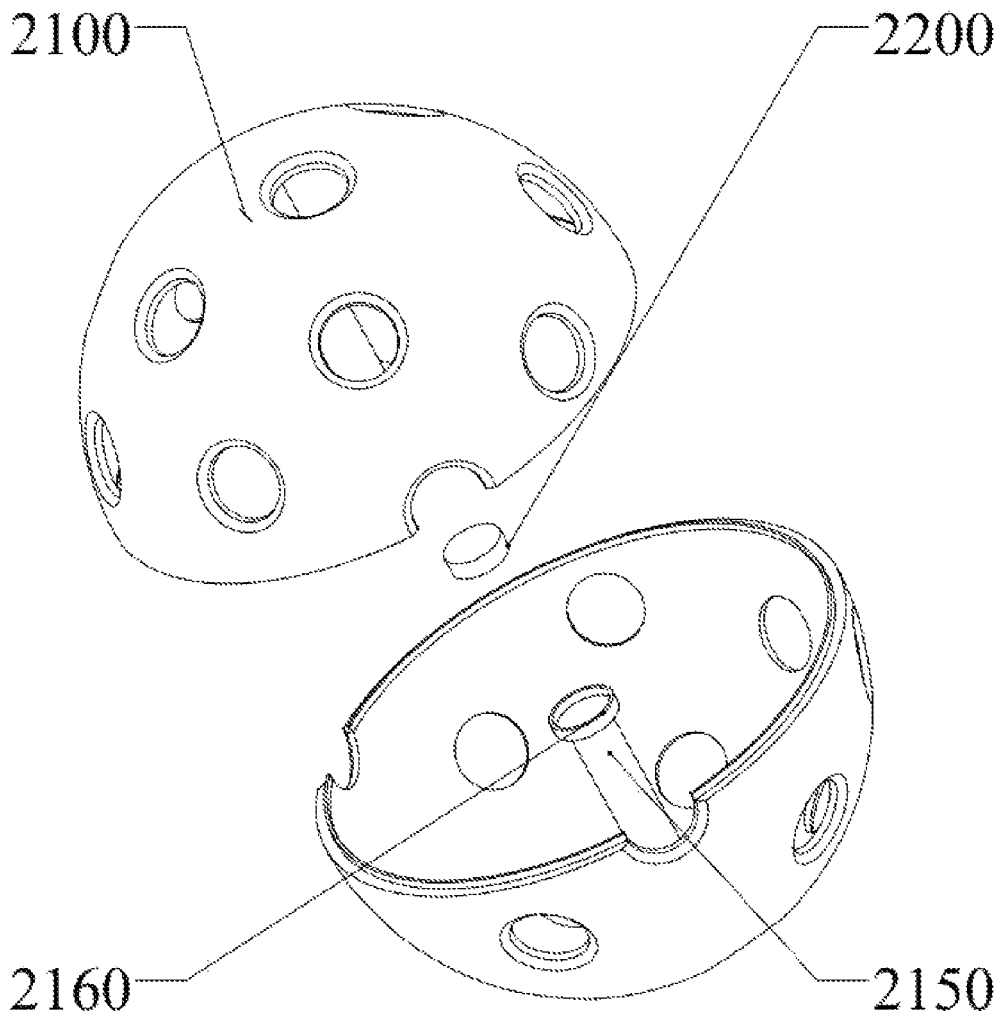
FIG. 11 is a schematic diagram of another embodiment of the present application.

Referring to FIGS. 10 and 11, further, a bracket 2150 is arranged inside the body 2100, and the head and tail of the bracket 2150 are located at two ends of the body 2100 respectively. A receiving seat 2160 is arranged at the center of the ball of the body 2100, and the receiving seat 2160 is arranged on the bracket 2150 for placing the second magnetic part 2200.

In this embodiment, the body 2100 includes an upper housing 2130 and a lower housing 2140, which are provided with buckles, and are detachably connected by the buckles. In another embodiment (not shown in the figures), magnets are arranged on the upper housing 2130 and the lower housing 2140, and the upper housing 2130 and the lower housing 2140 are detachably connected together through the magnets. In other embodiments (not shown in the figures), the connection methods also include but are not limited to threaded connection, or pin connection and other ways, as long as the upper housing 2130 and the lower housing 2140 can be normally connected and fixed.

Figure 12:
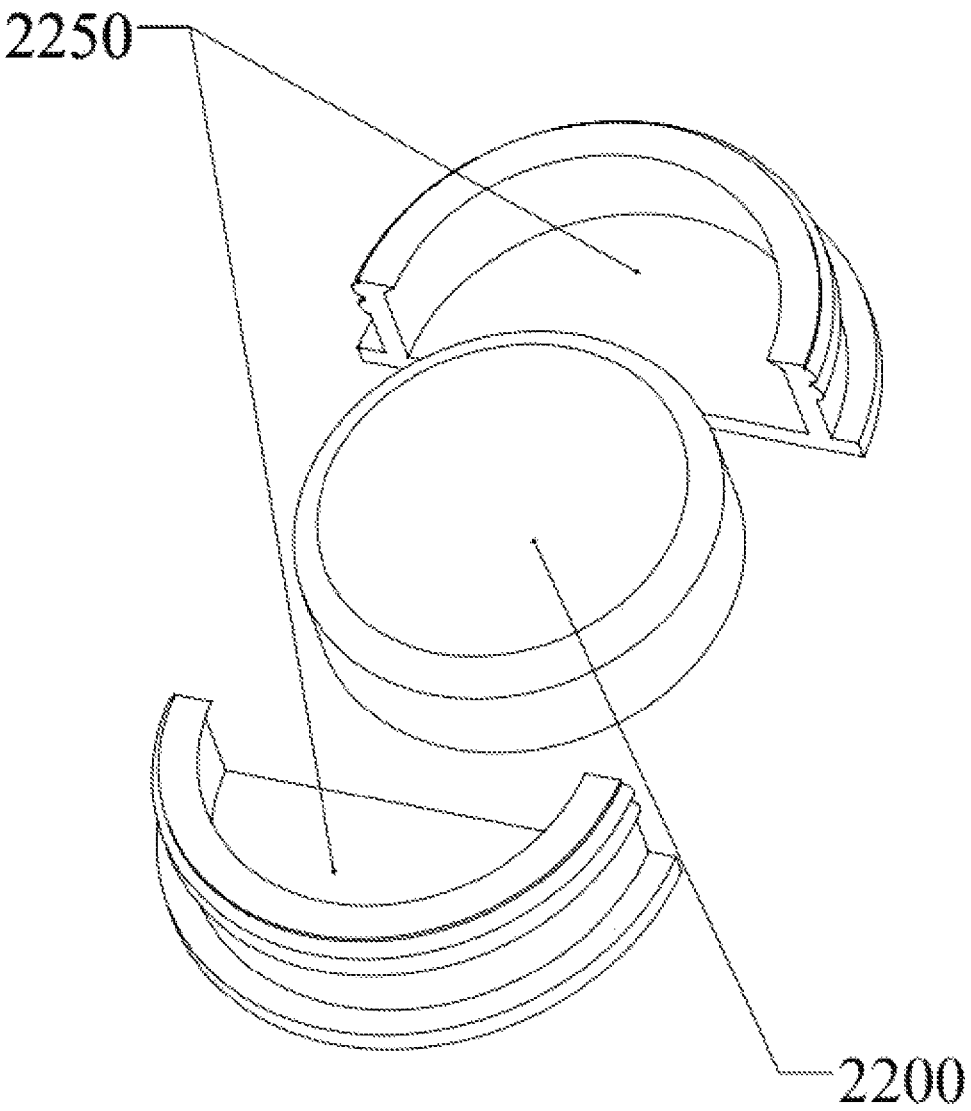
FIG. 12 is a schematic diagram of a component of the present application.
Figure 13:
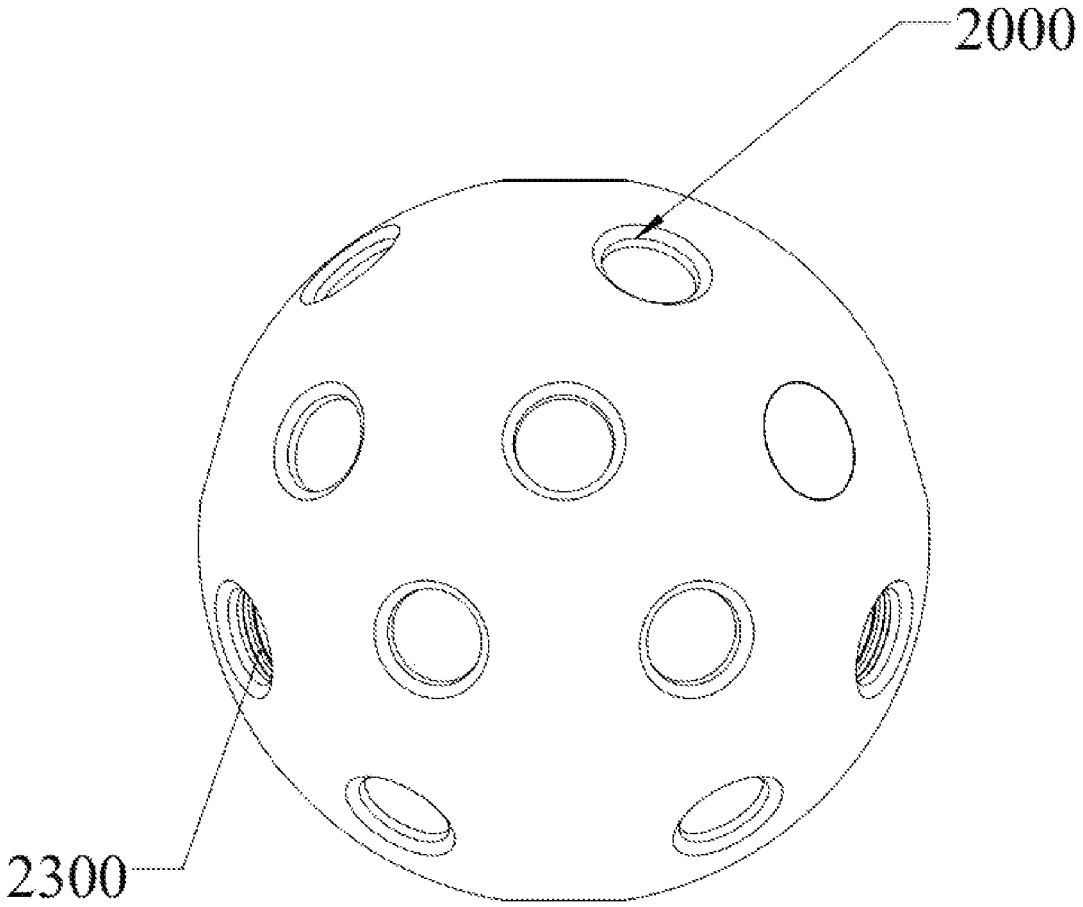
FIG. 13 is a schematic diagram of another embodiment of the present application.
Figure 14:
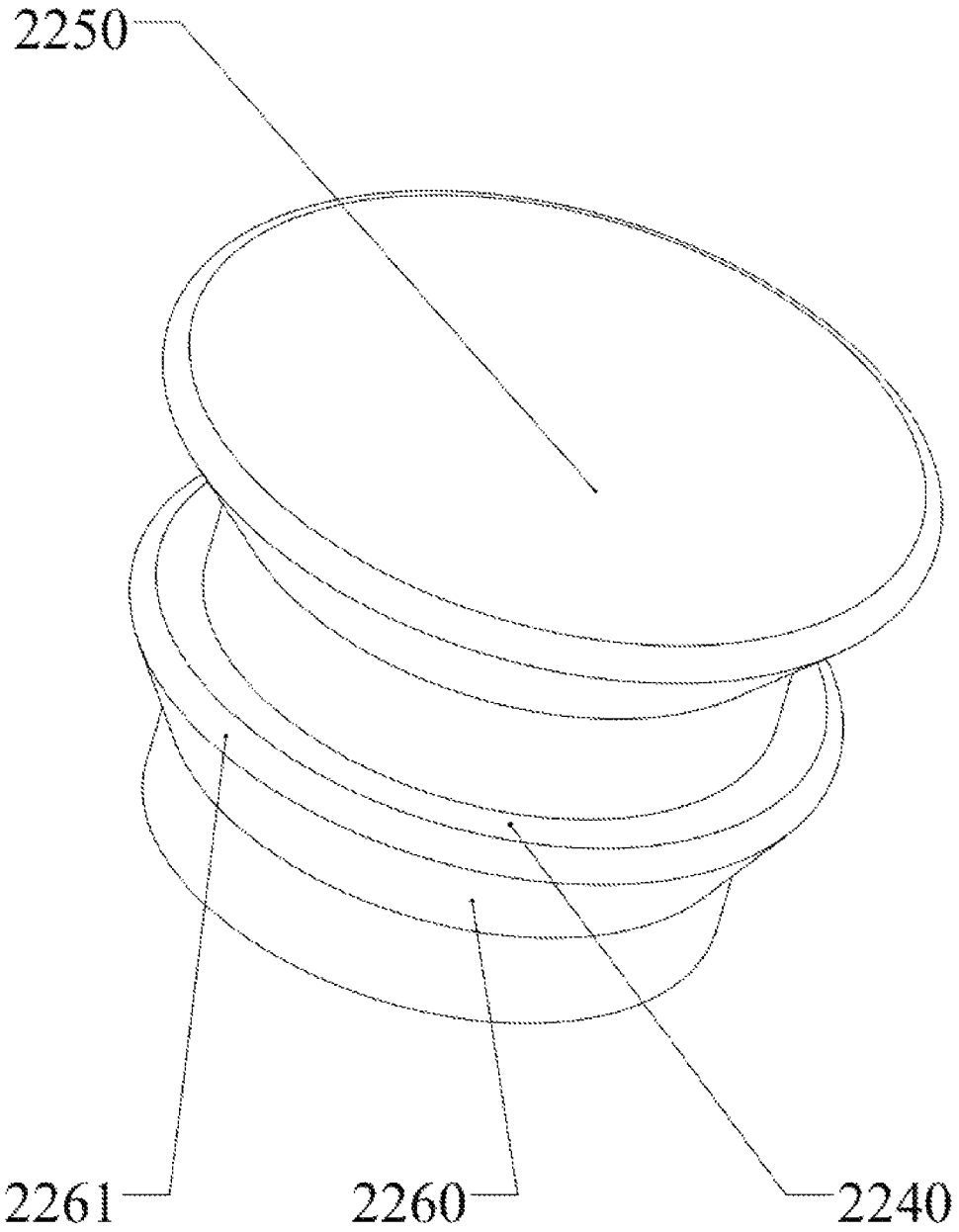
FIG. 14 is a schematic diagram of another embodiment of the present application.

Referring to FIG. 12 to FIG. 14, the second magnetic part 2200 is placed inside the two detachable Snap-on housings 2250, and when the second magnetic part 2200 is placed inside, the Snap-on housings 2250 will be closed, and the Snap-on housings 2250 will be snapped inside the magnetic pickup ball 2000 by means of the magnetic buckle 2240. This ensures that no matter how violent the impact is, the second magnetic part 2200 will not fall out of the Snap-on housing 2250 to the inside of the ball due to the impact. Thereby, the problem of the second magnetic part 2200 being unable to pick up the ball due to mutual repulsion with the first magnetic part 1200 is avoided.

Specifically, referring to FIG. 14, the magnetic buckle 2240 has a gradual incline 2260, with the uppermost end of the incline having a largest edge 2261, such that when the second magnetic part 2200 is placed within the magnetic pickup ball 2000, the incline 2260 allows the second magnetic part 2200 to be progressively embedded within the magnetic pickup ball 2000, which snaps inside the magnetic pickup ball 2000 by way of the edge 2261, thereby allowing the second magnetic portion 2200 to snap within the magnetic pickup ball 2000.

In this embodiment, the magnetic suction method of the multifunctional pick racket 1000 and the magnetic pickup ball 2000 is that the magnetic portion is coupled with the magnetic portion, or the magnetic portion is coupled with the magnet, so as to realize the ball picking method by the magnetic suction method.

In this embodiment, the magnetic suction method of the multifunctional pick racket 1000 and the magnetic pickup ball 2000 is that the magnetic portion is coupled with the magnetic portion, or the magnetic portion is coupled with the magnet, so as to realize the ball picking method by the magnetic suction method.

As a preferred embodiment of the present application, referring to FIG. 13, the present application also provides another magnetic pickup ball 2000. The magnetic pickup ball 2000 includes a hollow body 2100, and a plurality of second magnetic parts 2200 and a plurality of light component 2300 detachably attached to the body.

The body 2100 has an approximately spherical outer contour, and the body 2100 is provided with a plurality of holes 2110, and the holes 2110 are uniformly distributed on the approximately spherical outer surface of the body 2100. Specifically, the diameter of the open end 2220 is not larger than the diameter of the hole 2110, and the closed end 2210 also has a substantially spherical outer surface. The outer surface of the closed end 2210 is tangent to the outer surface of the body 2100. The second magnetic part 2200 is fixed in the hole 2110 of the body 2100 by embedding, so that the body 2100 becomes a roughly regular spherical shape.

The light component 2300 includes a connecting part and a light emitting part, the light component 2300 is located inside the body 2100, and the connecting part is in contact with the inner wall of the body 2100. A sensor is attached to the light component 2300 for receiving external signals and controlling the light component 2300. Meanwhile, the light component 2300 is also provided with an audio circuit, and the light emitting part is composed of lamp beads. The light component 2300 is wrapped and protected by a protective layer made of waterproof and shockproof materials, and the materials are not limited in this embodiment. In other embodiments, waterproof and shockproof materials, including but not limited to rubber, silica gel, polyurethane, vinyl, and other materials that can form a sealed protective layer, effectively prevent moisture from entering, and at the same time absorb impact force and reduce vibration.

Specifically, when the magnetic pickup ball 2000 is hit, the sensor will receive the signal of the impact, and control the light component 2300 to make the magnetic pickup ball 2000 emit sound effects and light. Therefore, it can play the role of venting, decompression, fun and so on, and at the same time can provide better visual effects.

As a preferred embodiment of the application of the present invention, the application of the present invention also provides the use method of the multifunctional pick racket 1000 and the magnetic pickup ball 2000, which is an innovative experience combining technology and sports. This kind of experience can not only exercise, but also bring visual enjoyment.

In this embodiment, the multifunctional pick racket 1000 includes a panel component 1400, a handle 1300, and a light-emitting component 1500. The panel component 1400 is made of a light-transmitting material, and the light source emission direction of the light-emitting component 1500 faces the panel component 1400. The purpose of this design is to make the panel form a beautiful lighting effect after the light-emitting component 1500 is started.

When the multifunctional pick Racket 1000 and the magnetic pickup ball 2000 are used, the light-emitting component 1500 is started to make the panel component 1400 form a lighting effect. As long as the power supply 1530 is turned on, the panel component 1400 will light up. Moreover, because the panel component 1400 is made of a light-transmitting material, when the light is on, the panel component 1400 will form a unique visual effect, which will have a shining effect on the people.

During use, the handle 1300 is held, the multi-functional pick racket 1000 swung to hit the pickup ball 2000 for physical exercise. This process is just like playing table tennis or badminton. Users can adjust the strength and angle of hitting the ball according to their own preferences and enjoy the fun brought by sports.

Because both the pick racket 1000 and the pickup ball 2000 are magnetic, they will have a special mutual attraction during the hitting process. This attraction can not only increase the accuracy of hitting, but also increase the challenge of sports.

Further, the design of the multifunctional pick racket 1000 is full of innovation and convenience. The multi-functional pick racket 1000 is provided with the first magnetic part 1200. When it is necessary to collect the pick ball, the pickup ball 2000 can be attracted to the multi-functional pick racket 1000 by magnetic attraction only by placing the first magnetic part 1200 near the pickup ball 2000. Therefore, no matter where the user plays, there is no need to worry about the difficulty of picking up the ball or bending over to pick up the ball.

In addition, the handle 1300 is also provided with a power supply 1530. This power supply 1530 can not only provide a working voltage for the light-emitting component 1500, so that the light-emitting component 1500 can work normally, but also supply power to external objects. This means that when the user is exercising outdoors, if the battery of the mobile phone or other electronic equipment is insufficient, the user can use this power supply 1530 to charge, which increases the practicability of the multifunctional pick racket 1000.

In some embodiments (not shown in the figure), the pick racket 1000 is provided with a sensor, and the switch 1521 is triggered by the vibration generated during hitting the ball. The pick racket 1000 can also adjust the brightness of the light-emitting component 1500 according to the magnitude of the vibration. The effect of hitting the ball is fed back in real time through the brightness of the light emitting element 1510.

The sensor includes, but are not limited to, accelerometers, optical devices, electromagnetic and capacitive sensors, contact devices, displacement sensors, piezoelectric sensors, piezoresistive devices, variable capacitors, servo devices, and audio devices, wherein the transmission of vibration can be gas, liquid or solid, including but not limited to microphones, seismic telephones, and the like.

Further, the pick Racket 1000 is also provided with a display panel and sound effects, and the number and intensity of hitting the ball can be displayed on the display panel by hitting the ball, and at the same time, the pick racket 1000 can also emit corresponding sound effects at the moment of hitting the ball. Therefore, the pick racket 1000 can be made more beautiful, the visual effect can be enhanced, and the user experience can be better.

Similarly, in other embodiments (not shown in the figure), the pick racket 1000 is equipped with a wall hanger through which the pick racket 1000 can be hung on the wall, or the pick racket 1000 is equipped with a charging base, which enables the pick racket 1000 to be placed vertically on a plane. At the same time, the pick racket 1000 can emit light by itself, and can emit light when it is hung on the wall or erected on the charging base, so as to function as a night-light. Whether staying at home or going out, the pick racket 1000 can provide decoration and lighting functions.

Further, a charging identification device is arranged in the charging base, and the identification device is an elastic conductive post, so that charging can be performed only when the pick racket 1000 is erected in the charging base and the elastic conductive post is pressed downward. When the conductive column pops up, it stops conducting electricity.

In other embodiments (not shown in the figure), each element in the pick racket 1000 and the pickup ball 2000 can be connected through a system network, including but not limited to a cellular network, a Bluetooth system, an intranet, a local area network, the Internet (HTTPS), a Wi-Fi network, and the like.

The pick racket 1000 is not only an innovative sports equipment, but also equipped with a special application software, which can track and record players' sports achievements in real time and generate virtual lists. In this way, players can clearly see their progress and compare it with other players.

In addition, this application also has social functions, which enables players to compete with netizens all over the world on the Internet. No matter in the park, gym or at home, as long as there is an internet connection, players can participate in the fierce pick ball game anytime and anywhere.

Furthermore, this application can update the competition data to the virtual list in real time, making every competition full of tension and excitement. No matter whether it's singles or doubles, players can play the game with friends and family through the pick racket 1000 and application software.

Generally speaking, the pick racket 1000 and its supporting application software have brought unprecedented convenience and fun to the sport of pick ball. It not only improves the interest in sports, but also enhances the sociality of sports. Whether you are a beginner or an experienced veteran in the sport of pick ball, you can find your own fun here.

Specifically, the design concept of the pick racket 1000 and pickup ball 2000 is to combine sports and technology perfectly. These two products can not only be used on the actual court, but also be connected to the network, allowing users to exercise on the virtual network. In this way, whether at home, in the office or outdoors, users can play pick ball at any time to realize the perfect combination of sports and entertainment.

More importantly, the design of the pick racket 1000 and pickup ball 2000 not only considers the sports function, but also considers the needs of daily life. When users don't use them for sports, the bright effect of the pick racket 1000 can be placed in the house as an ornament, adding the aesthetic feeling of the home environment. Moreover, when necessary, it can also provide a lighting function to provide convenience for users.

In addition, the pick racket 1000 also has the function of charging mobile devices. This means that no matter whether you are exercising outdoors or resting at home, as long as a user has the pick racket 1000 around, the user does not need to worry about the lack of battery on his mobile phone.

In another embodiment (not shown in the figure), the appearance of the pickup ball 2000 can be made into a toy appearance with five sense organs attached, and a sound module is implanted in the hole 2110 of the pickup ball 2000. When the racket hits the pick ball, hitting different holes 2110 can trigger different sound modules to make different funny sounds. At the same time, the pickup ball 2000 can also be used for children to play and pressing different holes 2110 can produce different sound effects, thus playing the role of venting, decompression, fun and so on.

In another embodiment (not shown in the figure), the appearance of the pickup ball 2000 can be oval, arc, square, or other characters, geometric figures, and irregular shapes.

Generally speaking, the pick racket 1000 and pickup ball 2000 are products that truly integrate sports, entertainment and life. They not only provide a brand-new sports experience, but also meet the needs of users in their daily lives.

In the broad aspect of the application of the present invention, the technologies involved in the pick racket 1000 and the pickup ball 2000 can also be used in other ball games and racket sports. For example, badminton, tennis, table tennis, squash, tennis, golf, baseball, ice hockey and other sports that require the use of rackets or clubs.

To sum up, the present invention provides a brand-new pick racket and pick ball. The pick racket and pick ball are innovative devices that combine sports and decorative functions, which can pick up a large number of pick balls in a short time without causing damage to the ball. At the same time, the pick racket and pick ball also have other functions to play more games, such as lighting. Through the innovative design of combining sports and entertainment, not only can users exercise in the daytime, but also users can increase the fun and visual effects at night or in a dark environment, constantly refreshing the users' freshness and further improving the users' experience.

The terms "comprising." "including," "having," and the like are synonymous and are used inclusively, in an open-ended fashion, and do not exclude additional elements, features, acts, operations, and so forth. Also, the term "or" is used in its inclusive sense (and not in its exclusive sense) so that when used, for example, to connect a list of elements, the term "or" means one, some, or all of the elements in the list. The use of "adapted to" or "configured to" herein is meant as open and inclusive language that does not foreclose devices adapted to or configured to perform additional tasks or steps. Additionally, the use of "based on" is meant to be open and inclusive, in that a process, step, calculation, or other action "based on" one or more recited conditions or values may, in practice, be based on additional conditions or values beyond those recited. Similarly, the use of "based at least in part on" is meant to be open and inclusive, in that a process, step, calculation, or other action "based at least in part on" one or more recited conditions or values may, in practice, be based on additional conditions or values beyond those recited. Headings, lists, and numbering included herein are for ease of explanation only and are not meant to be limiting.

The various features and processes described above may be used independently of one another or may be combined in various ways. All possible combinations and sub-combinations are intended to fall within the scope of the present disclosure. In addition, certain method or process blocks may be omitted in some implementations. The methods and processes described herein are also not limited to any particular sequence, and the blocks or states relating thereto can be performed in other sequences that are appropriate. For example, described blocks or states may be performed in an order other than that specifically disclosed, or multiple blocks or states may be combined in a single block or state. The example blocks or states may be performed in serial, in parallel, or in some other manner. Blocks or states may be added to or removed from the disclosed examples. Similarly, the example systems and components described herein may be configured differently than described. For example, elements may be added to, removed from, or rearranged compared to the disclosed examples.

The invention has now been described in detail for the purposes of clarity and understanding. However, those skilled in the art will appreciate that certain changes and modifications may be practiced within the scope of the appended claims. Conditional language used herein, such as, among others. "can," "could," "might," "may," "e.g.," and the like, unless specifically stated otherwise, or otherwise understood within the context as used, is generally intended to convey that certain examples include, while other examples do not include, certain features, elements, and/or steps. Thus, such conditional language is not generally intended to imply that features, elements and/or steps are in any way required for one or more examples or that one or more examples necessarily include logic for deciding, with or without author input or prompting, whether these features, elements and/or steps are included or are to be performed in any particular example.

What is claimed is:

1. A magnetic pickleball, comprising a hollow body and a plurality of second magnetic parts attached to the body, wherein, the body is provided with a roughly spherical outer hub, and a plurality of holes are also formed on the body, and the plurality of holes are evenly distributed around an outer surface of the body;

wherein a second magnetic part of the plurality of second magnetic parts comprises a closed end and an open end, and a diameter of the closed end is larger than that of the hole;

wherein when the plurality of second magnetic parts are attached to the body, the open end is embedded in the holes, so that the body forms a substantially regular ball;

wherein the open end continuously extends toward the closed end to form a convex column, wherein the convex column has an outer wall surface and an inner wall surface, and the inner wall surface defines a receiving groove; and wherein the second magnetic part further comprises a magnetic buckle, and the magnetic buckle is arranged in the receiving groove, wherein a side surface of the magnetic buckle is closely attached to the inner wall surface, so that the magnetic buckle is firmly arranged in the receiving groove.

2. The magnetic pickleball according to claim 1, wherein the second magnetic part is made of a rubber material.

3. The magnetic pickleball according to claim 2, wherein the second magnetic part is further provided with a tightening ring which is continuously molded around the open end, wherein an inner diameter of the tightening ring is smaller than a diameter of the magnetic buckle, and when the magnetic buckle is arranged in the receiving groove, the tightening ring limits the displacement of the magnetic buckle.

4. The magnetic pickleball according to claim 3, wherein the second magnetic part is further provided with a fastening hoop which is continuously molded around the outer wall surface, wherein an outer diameter of the fastening hoop is larger than a diameter of the hole, so that the second magnetic part is firmly embedded in the hole.

5. The magnetic pickleball according to claim 4, wherein the body and the second magnetic part are integrally formed.

6. The magnetic pickleball according to claim 4, wherein the body and the magnetic part are formed separately.

7. The magnetic pickleball according to claim 5, wherein the diameter of the open end is not greater than the diameter of the hole, and the closed end also has a substantially spherical outer surface, and the outer surface of the closed end is tangent to the outer surface of the body.

8. The magnetic pickleball according to claim 7, wherein the fastening hoop is made of an elastic material.

9. A magnetic pickleball, comprising a hollow body, and a plurality of second magnetic parts and a plurality of optical components detachably attached to the body;

wherein, the body is provided with a roughly spherical outer hub, and a plurality of holes are also formed on the body, and the holes are evenly distributed around an outer surface of the body;

wherein, a second magnetic part of the plurality of second magnetic parts comprises a closed end and an open end, the diameter of the closed end is larger than that of the hole, and when the plurality of second magnetic parts are detachably attached to the body, the open end is embedded in the hole, so that the body forms a substantially regular ball;

wherein the open end continuously extends toward the closed end to form a convex column, wherein the convex column has an outer wall surface and an inner wall surface, and the inner wall surface defines a receiving groove;

wherein the second magnetic part further comprises a magnetic buckle, and the magnetic buckle is arranged in the receiving groove, wherein a side surface of the magnetic buckle is closely attached to the inner wall surface, so that the magnetic buckle is firmly arranged in the receiving groove; and wherein, the optical component comprises a connecting part and a light-emitting part, the optical component is detachably connected to the body through the connecting part, and the light-emitting part emits light in response to a user's instruction.

10. The magnetic pickleball according to claim 9, wherein the diameter of the open end is not greater than the diameter of the hole, the closed end also has a substantially spherical outer surface, and an outer surface of the closed end is tangent to the outer surface of the body.

11. The magnetic pickleball according to claim 10, wherein the second magnetic part is embedded in the hole, the plurality of optical components are located inside the body, and the connecting part is in contact with an inner wall of the body.

12. The magnetic pickleball according to claim 11, wherein a sensor is attached to the optical component, and the sensor is used for receiving external signals and controlling the optical component.

13. The magnetic pickleball according to claim 12, wherein the optical component is further provided with an audio circuit, and when the magnetic pickleball is hit, the sensor will control the light-emitting part to emit light and sound.

14. The magnetic pickleball according to claim 13, wherein the light-emitting part is composed of at least one lamp bead, and the lamp bead is specifically set as a monochromatic lamp bead or a multicolor lamp bead.

15. The magnetic pickleball according to claim 14, wherein the optical component is wrapped and protected by waterproof and shockproof materials.

* * * * *